US009500354B2

(12) United States Patent
Gierens et al.

(10) Patent No.: US 9,500,354 B2
(45) Date of Patent: Nov. 22, 2016

(54) LIGHTING UNIT MADE UP OF AN INSULATING GLASS PANEL AND LIGHT-EMITTING DIODES

(75) Inventors: Anne Gierens, Compiegne (FR); Aude Montgermont, Paris (FR); Jingwei Zhang, Massy (FR)

(73) Assignee: SAINT-GOBAIN GLASS FRANCE, Courbevoie (FR)

( * ) Notice: Subject to any disclaimer, the term of this patent is extended or adjusted under 35 U.S.C. 154(b) by 306 days.

(21) Appl. No.: 14/124,978

(22) PCT Filed: Jun. 7, 2012

(86) PCT No.: PCT/FR2012/051280

§ 371 (c)(1),
(2), (4) Date: Jan. 10, 2014

(87) PCT Pub. No.: WO2012/168661

PCT Pub. Date: Dec. 13, 2012

(65) Prior Publication Data

US 2014/0153220 A1 Jun. 5, 2014

(30) Foreign Application Priority Data

Jun. 9, 2011 (FR) ..... 11 55071

(51) Int. Cl.

| | |
|---|---|
| ***F21V 29/00*** | (2015.01) |
| ***F25D 27/00*** | (2006.01) |
| ***E06B 3/66*** | (2006.01) |
| ***F21V 31/00*** | (2006.01) |
| ***F21V 29/70*** | (2015.01) |

(52) U.S. Cl.

CPC ..... *F21V 29/22* (2013.01); *E06B 3/66* (2013.01); *F21V 29/70* (2015.01); *F21V 31/005* (2013.01); *F25D 27/00* (2013.01)

(58) Field of Classification Search

CPC ..... E06B 3/66; F21V 29/22; F21V 31/005; F25D 27/00

See application file for complete search history.

(56) References Cited

U.S. PATENT DOCUMENTS

2004/0031234 A1 2/2004 Emde
2004/0040228 A1* 3/2004 Emde ..... B32B 17/10165 52/173.3

FOREIGN PATENT DOCUMENTS

| | | |
|---|---|---|
| EP | 2 101 309 | 9/2009 |
| WO | WO 02/085806 | 10/2002 |
| WO | WO 2004/007887 | 1/2004 |

OTHER PUBLICATIONS

International Search Report as issued for International Application No. PCT/FR2012/051280, dated Aug. 29, 2012.

* cited by examiner

*Primary Examiner* — Thomas M Sember
(74) *Attorney, Agent, or Firm* — Pillsbury Winthrop Shaw Pittman LLP

(57) ABSTRACT

A lighting unit includes a glass panel including at least two spaced sheets of glass, and a lighting system based on light-emitting diodes the light-emitting portion of which is disposed facing each of the edge surfaces of the sheets of glass and carried by at least one section associated at least with the edge surface of the glass panel. The section is associated with the edge surface of the glass panel without creating thermal bridges. It is attached against the edge surface of the glass panel or demountably fixed to it.

25 Claims, 5 Drawing Sheets

LIGHTING UNIT MADE UP OF AN INSULATING GLASS PANEL AND LIGHT-EMITTING DIODES

CROSS-REFERENCE TO RELATED APPLICATIONS

This application is the U.S. National Stage of PCT/FR2012/051280, filed Jun. 7, 2012, which in turn claims priority to French Application No. 1155071, filed Jun. 9, 2011. The content of both applications are incorporated herein by reference in their entirety.

The invention concerns a lighting unit made up of a multipart illuminated glass panel of the double glass panel type comprising at least two sheets of glass and a lighting system based on light-emitting diodes (LED).

The glass panel may comprise more than two sheets of glass. The glass panel could be insulated by virtue of the presence of at least one layer of gas or by virtue of being evacuated.

Lighting based on LEDs associated with glass is expanding because of its advantages, such as low energy consumption and durability.

For example, patent application US2004031234 proposes a diode-based illuminated window consisting of an insulated double glass panel with diodes assembled to the edge surface of the glass panel via a U-section with a central core facing the edge surface of the double glass panel and at the distal ends two lateral parts gripping the borders of the external main surfaces of the insulated double glass panel. The diodes are arranged on a series of printed circuit boards, everything being embedded in a transparent plastic.

Thus the object of the invention is to propose an alternative diode-based multipart illuminated glass panel notably having both the optical performance and the conventional (thermal, mechanical, etc.) performance required for windows.

In the remainder of the description, the "length" of an element is the longitudinal magnitude of that element. The "width" of the element corresponds to the dimension transverse to and coplanar with the length, while the "thickness" is by extension orthogonal to the width and the length.

The invention relates to a lighting unit comprising:

- an insulated and illuminated multipart glass panel, in particular for use between an exterior and an interior of a building or vehicle, the glass panel comprising at least first and second sheets of glass spaced from each other (by means of a spacer) with respective first and second edge surfaces and associated by means of peripheral sealing means such as mastic between the sheets of glass,
- a lighting system comprising at least one support and electrical connection device called a PCB device carrying light-emitting diodes disposed facing the first edge surface, and
- at least one section comprising a longitudinal base, notably of rectangular cross-section and/or having a width equal to that of the edge surface of the glass panel, which section carries the PCB device (independently), the PCB therefore being attached or fixed to the base, notably removably, preferably by means of a double-sided adhesive tape or mechanical screw or clip type means, the section being associated with the glass panel (with the edge surface of at least one side of the glass panel, in a top or association plane of the section that corresponds to the plane of the section that is associated with and faces the glass panel) without creating thermal bridges.

The unit includes no element, notably not even another U-section, liable to create thermal bridges.

The insulated glass panel may be a standard insulated glass panel with the two sheets of glass spaced by a layer of air or gas. Alternatively, it may be an evacuated glass panel.

By "associated" is meant placed against, either fixed to or not.

The section forms support means of the lighting system and means for associating said lighting system with the glass panel, association of the section with the glass panel consisting in assembly of the section with the glass panel, preferably removable assembly, or placement against the glass panel.

In accordance with one feature of the invention, the unit includes a part adapted to maintain a gap between the light-emitting face of the diodes and the glass panel (the edge surface of the glass panel), which part may be a portion of the section. The part is notably attached, even fixed, to the base of the section; it also projects relative to the base at least in a central part facing the spacer of the glass panel, having a width less than the base or even a width equal to that of the spacer. The part may be in one piece or consist of a plurality of pieces. It may be formed in one piece with the base of the section. The part or the section may be of rectangular section, L-section (with a 90° return), or T-section (inverted) or include two inverted U-shapes, the concave sides of the U-shapes facing the base, in particular facing the edge surfaces of the two sheets of glass. The part independent of the section or the portion of the section forming the separator part may be made of plastic material or metal or composite material. The part may be made of different materials, and at least one portion (lateral and/or central portion(s)) may be made of metal, with no metal part (either in one-piece or consisting of a plurality of abutted pieces) being in contact with both sheets of glass at the same time. There is no risk of the diodes touching the module. They are protected. They do not project outside the surface of the section nearest the module.

In accordance with another feature of the invention the unit includes a solid surface of an attached part or of the section, the solid surface being adapted to form a bearing abutment for the glass panel (and a support abutment for the glass panel given its weight). This solid surface has a width equivalent (equal) to the thickness of the glass panel for the lower side of the glass panel in its mounted position and is disposed against the whole of the width of the edge surface of the glass panel (without projecting). As a function of the material of this surface facing the diodes, if the latter material is not transparent, the solid surface includes holes in line with the diodes. In respect of the bottom side of the glass panel, given the weight of the glass panel, the section advantageously extends over the entire length of the side in order to form a substantial bearing surface.

In one embodiment, the section is disposed or attached against the edge surface of the glass panel, in particular only disposed or attached, without being fastened.

In another embodiment of the invention, the section is fixed, in particular only at the level of the edge surface of the glass panel, preferably at least at the level of the sealing means, preferably by removable fixing means. The fixing means do not extend into the interior of the glass panel, between the sheets of glass, to guarantee the sealing of the glass panel.

The fixing means are chosen from a double-sided adhesive tape or mechanical means of the screw or clip type, notably cooperating with an insert, in particular a plug mounted in the sealing means provided in particular with a cavity, notably a molded cavity.

The section comprises a central portion including guide means for positioning the section relative to the glass panel, which enables fast mounting of the section, which is correctly positioned by virtue of being centered on the edge surface of the glass panel so as not to project from its periphery and to ensure alignment of the diodes with the edge surface or edge surfaces of the sheets of glass. The guide means consist for example of at least two holes in the vicinity of the respective ends of the section and preferably a plurality of holes distributed and aligned along the central longitudinal axis of the section.

The section includes an upper portion of thermally insulative material such as plastic material, the upper portion facing and being placed against the glass panel, at least in an area that does not face the diodes, notably in a central area facing the spacer of the glass panel, said upper portion either forming an integral part of the section or being an attached part. The upper portion of the section extends the width of the first edge surface and the width of the sealing means and preferably the width of the second edge surface of the glass panel.

In accordance with another feature of the invention, the section includes an upper portion in which the unit includes a part, notably in a central area facing the spacer of the glass panel, the upper portion of the section or this part projecting from the diodes and consisting of a spacer between the diodes and the glass panel and/or a bearing surface for at least the lower side of the glass panel when the glass panel is in use. The upper portion of the section or this part thus forms an interface surface between the tops of the diodes and the glass panel, protecting the diodes from impact when the section is attached against the edge surface of the glass panel. Furthermore, when the section is mounted against the lower side of the glass panel, the upper portion of the section or this part acts as a bearing surface supporting the weight of the glass panel.

The section advantageously includes one or more housings, preferably a housing facing each glass sheet edge surface, to accommodate the diodes and their PCB device without the diodes projecting beyond the upper plane of the section associated with the glass panel.

The section preferably has a bottom or base opposite the glass panel and includes heat-dissipating means associated with the PCB device, the heat-dissipating means being made of metal and accommodated against the bottom or a portion thereof.

The section may include two lateral metal portions, in particular forming heat-dissipating means associated with the PCB device, the two lateral metal portions being separated from the sheets of glass, notably from the edge surfaces of the sheets of glass, by thermally insulative material of the seal or adhesive type or spaced from the sheets of glass by air.

The lighting system is arranged at the level of the horizontal bottom side of the glass panel in the mounted position of use of the glass panel, the section forming at least one abutment on which the edge surface of the glass panel bears and is supported, preferably a single longitudinal abutment over most or even all of the length of the horizontal bottom side, and/or the abutment or abutments preferably being disposed, in the areas outside the diodes, over most or even all of the width of the edge surface of the glass panel.

In one embodiment, the section includes a base and a cap, fastened on or removable, capping the diodes and the PCBs and adapted to allow light to pass from the diodes towards the glass panel. The cap is advantageously hollow and faces the base, for example with at least one inverted U-section or Ω-section, the hollow of the U-shape forming a housing accommodating the diodes. The cap may be transparent at least in line with the diodes to allow light to pass through. In a preferred variant, it includes orifices that face the diodes, for example of circular or oblong shape.

The section does not face the main surfaces of the glass panel, the section preferably has a width at most equivalent (equal) to the thickness of the glass panel and preferably faces the edge surfaces of the two sheets of glass. Preferably only one frame element of the window frame type, such as a glazing bead, could therefore face the main surfaces of the glass panel. This frame accommodates the periphery of the unit in accordance with the invention, the frame housing the periphery of the glass panel and the section associated with the glass panel and carrying the lighting system, the periphery of the glass panel being associated with the frame with sealing means of the gasket type between them. This frame could be of U-section and/or made of metal, for example. Only this frame of the usual type would include returns associated with the external faces of the glass panel. Consequently, in accordance with the invention, no section separate from the frame faces the main surfaces of the glass panel.

The lighting system is waterproof by virtue of a coating protecting the diodes and the face of the PCB device carrying the diodes.

The PCBs and the diodes are coated with an electrically insulative paint and are waterproof.

In accordance with the invention, the lighting unit is preferably integrated into a frame, possibly resting on spacers when in conjunction with the frame it forms a window, the section not projecting beyond the external faces of the glass panel so as not to impede the returns of the frame associated with the external faces of the glass panel.

The frame may be made of wood, PVC, metal (aluminum), etc.

The lighting unit of the invention is suitable for any type of use linked to the outside, such as window, façade, store window, illuminated interior roof, door Judas hole, rail vehicle, etc.

By way of example, the lighting unit is used in

- a building, as an illuminated façade, an illuminated window, a ceiling, an illuminated floor or wall tile, an illuminated glazed door, an illuminated partition, an illuminated ceiling, a staircase step, a guard rail, a balustrade, a counter,
- a transport vehicle, as an illuminated side window or an illuminated glazed roof or an illuminated window or rear window, an illuminated glazed door, notably in private vehicles such as automobiles, trucks, or public transport vehicles such as trains, metros, trams, buses, or aquatic or airborne vehicles (aircraft),
- road or street lighting,
- glass panels of urban street furniture, such as an illuminated glazed portion of a bus shelter, a balustrade, a display, a store window, a shelving unit, a greenhouse,
- an interior furniture glass panel, such as an illuminated bathroom wall, an illuminated mirror, an illuminated glazed portion of a piece of furniture,
- a glazed portion, notably door, glazed shelving unit, lid of domestic or professional refrigeration equipment.

The glazed surface preferably includes means for diffusion of light when lit by diodes. For an illuminated partition, shelving unit, store window or corporate premises, the geometrical shape of the combination of the enamel and the transparent glazed surface advantageously corresponds to a logo.

The present invention is described next with the aid of nonlimiting illustrative examples of the scope of the invention and the appended drawings, in which:

FIG. 1 shows a front view of a window incorporating an insulated and illuminated multipart glass panel in accordance with the invention, FIG. 2 represents a partial diagrammatic view in section and from the side of the lower portion of the window from FIG. 1, the view in section corresponding to the section line A-A in FIG. 4, in the area in which the section carrying the lighting system is fixed to the glass panel;

FIGS. 11*a* to 13*c* are sectional views of other variants of the section as seen from above.

Figure 1:
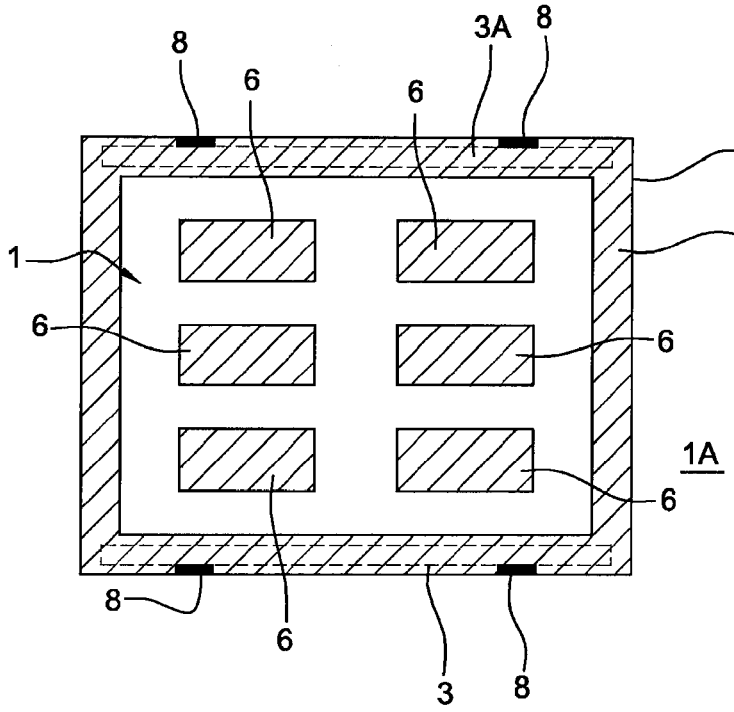

FIG. 1 shows a lighting unit in accordance with the invention mounted in a wooden frame 1B to form a window 1A. The lighting unit comprises an insulated and illuminated glass panel 1 installed via spacers 8 in the woodwork, which is provided in particular with a glazing bead 1C.

In accordance with the invention, the glass panel 1 of the window is an illuminated glass panel associated via at least one section 3 shown in dashed outline and concealed in the frame by the glazing bead 1C with a lighting system based on light-emitting diodes.

In the position of the glass panel when mounted in the frame, the glass panel is preferably associated with a bottom section 3 and a top section 3A.

Figure 2:
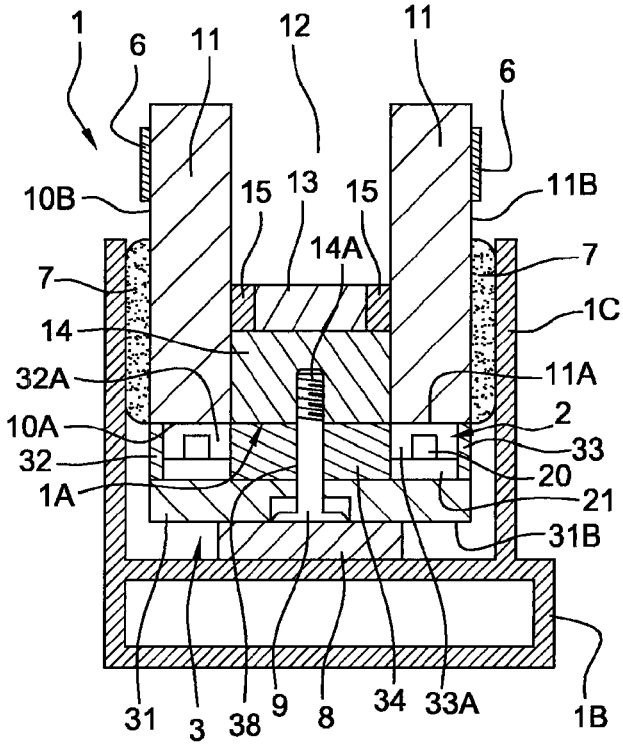
Figure 3:
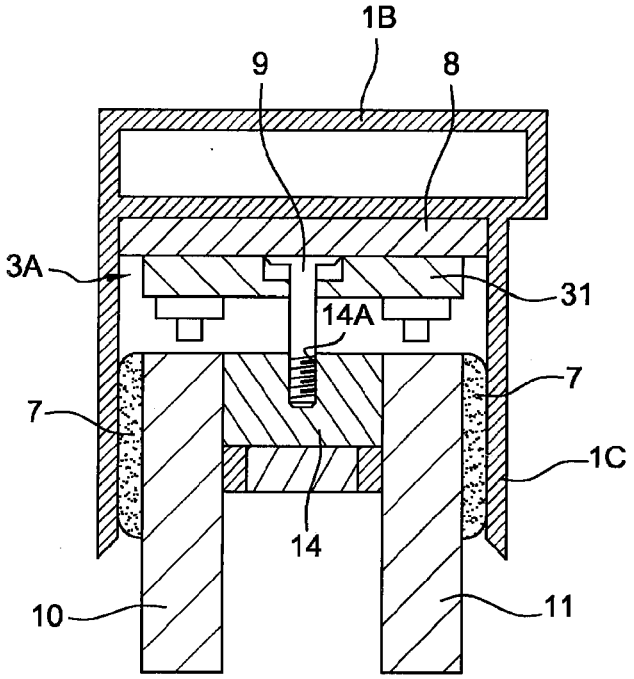
FIG. 3 is the equivalent of FIG. 2 for the upper portion of the window.

The insulated and illuminated glass panel 1 shown partly in section in FIGS. 2 and 3 includes in particular in the known manner two sheets 10 and 11 of glass separated by a layer 12 of air or gas, an insert or spacer frame 13, also known as a "spacer", which serves to hold the two sheets of glass apart, and sealing means 14 that provide the seal between the interior of the sheets of the glass and the exterior.

The insert 13 is usually fixed inside the glass panel by fixing its lateral faces to the internal faces of the sheets of glass by means of butyl rubber 15 which also has the function of sealing the interior of the glass panel against water vapor. The insert 13 is set back inside the glass panel and in the vicinity of the edge surfaces 10A and 11A of said sheets of glass so as to provide a peripheral groove into which the mastic-type sealing means 14, such as polysulfide or polyurethane, are injected. The mastic strengthens the mechanical assembly of the two sheets of glass and provides a seal against liquid water and solvents.

The glass panel has the following thicknesses, for example: 4 mm for each of the edge surfaces of the sheets of glass and 16 mm for the layer of gas.

In accordance with the invention, the glass panel 1 is illuminated thanks to a diode-based lighting system 2 that is associated with said glass panel via the top section 3 and the bottom section 3A.

The lighting system 2 cooperates with the edge surface 1A of the glass panel, more particularly with the edge surfaces 10A and 11A of the sheets of glass, to direct light toward said edge surfaces.

The lighting system 2 is positioned against at least one side of the glass panel (over all or part of its length) and may for example extend over two opposite sides, and even over the whole of the periphery, at the level of the bottom, the top, the sides in the position of use of the glass panel. It is preferably associated on two sides with the top and bottom of the glass panel in the mounted position of the window, as shown here.

The lighting system includes diodes 20 that are disposed in a known manner on supporting and electrical power supply devices 21 of the printed circuit board (PCB) type. An electrically insulating varnish is provided on the connections of the diodes. The PCBs are connected to one another. Before leaving the woodwork via a hole bored in one corner (at the top or bottom, as required), an electrical cable that is not shown is routed in the frame in the vicinity of the section 3.

The lighting system 2 is preferably waterproof, the diodes being covered with a waterproof protecting resin. In fact, water or condensation is always liable to infiltrate into the woodwork.

The size of the diode is for example 3.5 mm×2.8 mm.

The lighting being based on diodes, the glass panel preferably comprises means 6 for diffusing light associated with the faces of the glass, either and preferably outside the glass panel on the external faces 10B and 11B (FIG. 2) or inside it (not shown).

The diffusing means 6 are preferably screen-printed onto the glass using white enamel, for example. They extend over the glass in a chosen arrangement and patterns. They do not necessarily cover the whole of the surface of the glass of the module and may therefore delimit so-called functional dark areas. The dark areas are for example disposed at the centre or periphery of the module. They consist for example of transparent (clear glass) areas or opaque areas such as a decorative enamel, or mirrors.

The bottom section 3 and the top section 3A each incorporating the lighting system 2 are as close as possible to the edge surface 1A of the glass panel (against it in the case of the bottom section and at a distance of approximately 1 to 2 mm from it in the case of the top section) in order for the diodes 20 to illuminate each edge surface of the sheets of glass or at least the edge surface of one sheet of glass.

Each section 3, 3A therefore has a preferably plane so-called lighting face facing the edge surface of the glass panel and an opposite plane face 31B pressed against the inside of the frame.

Where the bottom portion of the window is concerned (see FIG. 2), the bottom section 3 incorporates and protects the lighting system 2. Furthermore, it provides the function of bearing and supporting the glass panel in the mounted position; thus the section is in direct contact with the edge surface of the glass panel.

Moreover, in a window, it is necessary to line up the glass panel in the frame. For this purpose, spacers 8 are provided at the periphery of the glass panel and in particular in the bottom and top portions of the window (see FIGS. 2 and 3), bearing against the frame and on which the section 3 rests.

Where the top portion of the window is concerned (see FIG. 3), the top section 3A has no glass panel supporting function and therefore does not need to be in intimate contact with the edge surface of the glass panel. The configuration of the top section may be simplified compared to that of the bottom section (see below).

Although the bottom section 3 is fixed to the glass panel (see below), it may instead simply be placed against the glass panel. The glass panel is therefore placed on the bottom section.

The section 3, respectively 3A, preferably has a width equivalent to the edge surface 1A of the glass panel as a whole (glass panel total thickness) without extending beyond or covering the external main surfaces 10B and 11B of the sheets of glass.

The section may be extended by one or two lateral parts beyond the edge surface of the main surfaces in a direction orthogonal to said faces, remaining within appropriate dimensions for the housing of the section in the frame of the window. The section may be extended by one or two lateral portions beyond the edge surface of the main surfaces in a direction parallel to said surfaces (facing them), but over a width limited to a few millimeters in order not to impede the fitting of the glazing bead and to leave free the exterior space separating said faces of the glazing bead for positioning the seal 7 of the woodwork (FIGS. 2 and 3).

The section 3 or 3A incorporating the lighting system 2 includes a base 31 used to assemble the section with the glass panel and also to support the lighting system 2.

The base 31 is solid and of elongate parallelepiped shape. Its two opposite main surfaces are plane, one accommodating the PCB(s) 21 of the diodes and facing the edge surface of the glass panel; the other surface faces the frame.

A plurality of PCBs 21 are arranged adjacent each other along the section.

The diodes 20 (PCB 21) could be assembled with the required distribution just before associating the section with the glass panel. The sections could be manufactured and shipped with the diodes or manufactured with the appropriate cavities to receive the diodes subsequently.

The width of a PCB is less than or equal to the width of an edge surface of a sheet of glass.

In accordance with the invention the bottom section 3 must support the weight of the glass panel when the latter is mounted in the woodwork. To this end (see FIG. 2), it includes a central portion 34 projecting from the base 31 in the direction of the glass panel and two end lateral walls 32 and 33 spaced from the central part 34 and extending orthogonally from the respective opposite edge surfaces of the base 31 in the direction of the glass panel.

The central portion 34 is intended to be in direct contact with the mastic 14 of the glass panel placed between the two sheets of glass while the lateral walls 32 and 33 are intended to be in direct contact with the edge surfaces 10A and 11A of the sheets of glass.

The portion 34 forms a solid surface facing the glass panel that provides a bearing abutment for the glass panel. In a variant which is not shown, independently of the configuration of the section, the unit in accordance with the invention includes a part placed between the section and the glass panel and the surface of which facing the glass panel forms a bearing abutment.

The central portion 34 and the lateral walls 32 and 33 each have a height (i.e. a dimension orthogonal to the main surfaces of the base 31) greater than the height of the PCB 21 and the diodes 20, so as to project beyond the light-emitting distal end surface of the diodes (approximately 2 mm).

The free edges of the central portion 34 and the walls 32 and 33 on the side opposite the base are coplanar and serve as bearing surfaces for the whole of the edge surface 1A of the glass panel.

Furthermore, the central portion 34 and the lateral walls 32 and 33 delimit two cavities 32A and 33A in which the diodes 20 are housed and constitute protection means for the diodes with no risk of them being damaged by the weight of the glass panel.

The bottom section 3 is preferably made from a plurality of components, the base 31 itself constituting at least one component and the central portion 34 and the lateral walls 32 and 33 forming a one-piece second component. This configuration is described hereinafter.

The bottom section 3 is assembled to the glass panel using removable fixing means, preferably screws 9 (FIG. 2) that on the one hand pass through the base 31 and the central portion 34 via a through-hole 38 and on the other hand are inserted into the mastic 14.

The bore 38 advantageously constitutes guide means for ideally positioning the section against the edge surface of the glass panel in order for it to be correctly centered relative to this edge surface to achieve balanced bearing of the glass panel on the section and to arrange the lighting system correctly facing the sheets of glass.

As already stated, the bottom section could simply be pressed against the glass panel, without fixing it by means of the screws 9. This variant is not shown.

Figure 4:
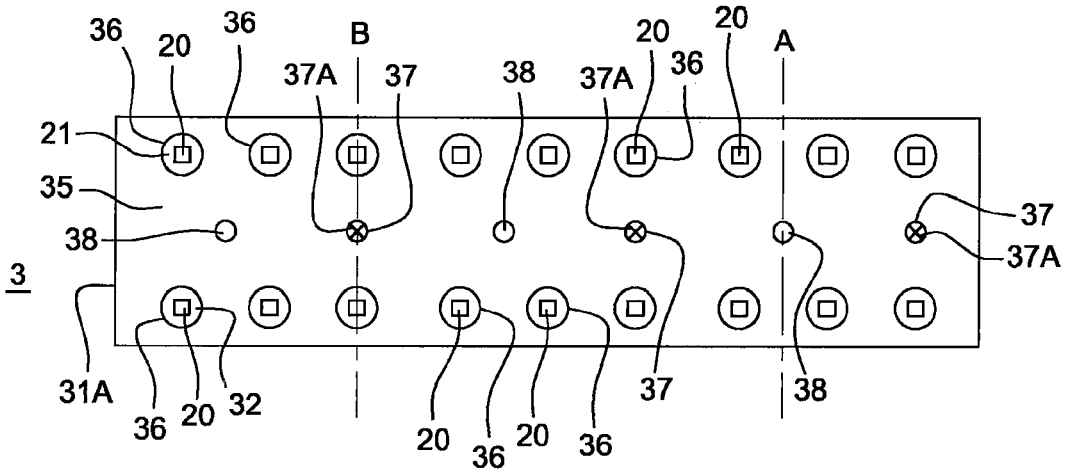
FIG. 4 is a plan view of the section carrying the lighting system shown in FIG. 2.

The section 3, shown from above in FIG. 4, includes a plurality of bores 38 distributed centrally along the section 3 adapted to cooperate with screws of the same type as the screws 9 for assembling the section along the whole of the bottom edge of the glass panel.

To facilitate the placement of the screws, the mastic 14 preferably includes bores 14A adapted to receive plug type inserts for the screw bodies 9 to be screwed into. The bores are produced during manufacture of the glass panel, at the time of depositing the mastic, which is soft at this stage.

The screws 9 pass through the whole of the thickness of the section from the face of the base 31 facing the frame and beyond the opposite face of the section formed by the edge surfaces of the central portion 34 and the lateral walls 32 and 33.

In order for the face 31B of the section facing and placed against the frame to be pressed flat against the frame, the screw heads 9, which are preferably flat, do not project out of the section, the face 31B advantageously including a spot facing to accommodate the screw head.

Alternatively, the removable fixing of the section to the glass panel may be effected by removably sticking it using double-sided adhesive tape. However, fixing by mechanical means (nails, screws, etc.) is more robust and durable and ensures that it is easy to demount the section afterwards to change the PCBs carrying the diodes without damaging them.

With reference to FIG. 3, the top section 3A does not necessarily need a central portion and lateral walls because it does not support in any way the weight of the glass panel. It may consist only of the base 31. On the other hand, in order to avoid damaging the diodes, it is necessary that their light-emitting end surfaces are not pressed against the sheets of glass but at a distance of at least 1 mm or even 2 mm therefrom. To this end, if there are no lateral walls that form spacers, the depth of the bore 14A or of the insert in the sealing mastic 14 is such that the maximum tightening of the screws enables this distance between the diodes and the sheets of glass to be achieved.

The bottom section 3 of the preferred embodiment of the invention is made up of a plurality of elements, the base 31 itself constituting at least one element and the central portion 34 and the lateral walls 32 and 33 forming a one-piece second element.

Figure 5:
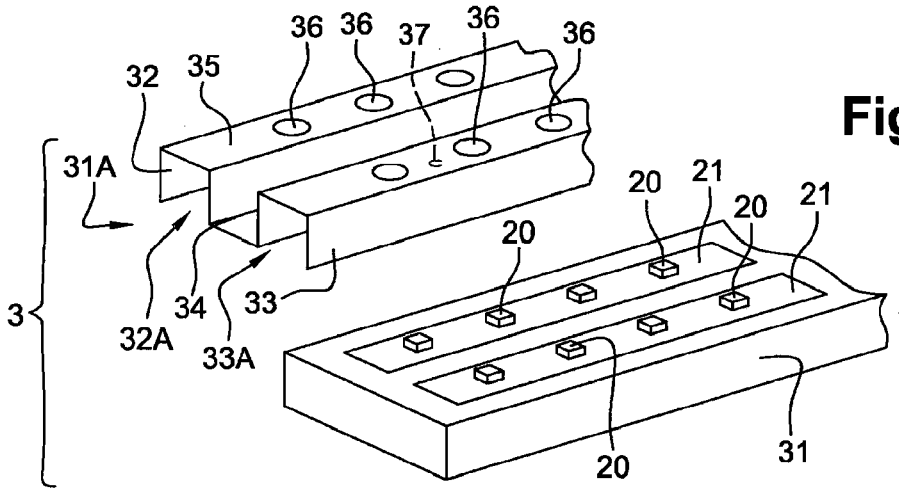
FIG. 5 is an exploded perspective view of the bottom section from FIGS. 2 and 4.

With reference to FIG. 5, the one-piece second element (central portion 34 and lateral walls 32 and 33) forms a longitudinal cap 31A that includes two longitudinal cavities 32A and 33A delimited by the solid central portion 34 and the two lateral walls 32 and 33.

The cap 31A is designed to be attached against the base 31 after placement and even fixing of the PCB or PCBs 21 of the diodes to said base 31. The PCBs are fixed either removably (by means of screws) or permanently. To change the diodes during use of the glass panel, either the PCBs 21 are changed, if they are removable, or the base 31 carrying the PCBs is changed.

The longitudinal cavities 32A and 33A of the cap provide housings for the diodes, the PCBs 21 resting on the base 31 at a distance from the top face of the cap.

FIG. 4, which shows the bottom section 3 as seen from above, shows the cap 31A attached to the base 31 provided with the diodes 20.

The cap 31A therefore has its cavities facing the base 31 and is intended to have its closed opposite face 35 face the glass panel. However, it includes within the thickness of its closed face 35 orifices 36 that are intended to face the diodes, thus enabling light from the diodes to escape from the section 31, which light is directed towards the edge surface of the glass panel.

Figure 6:
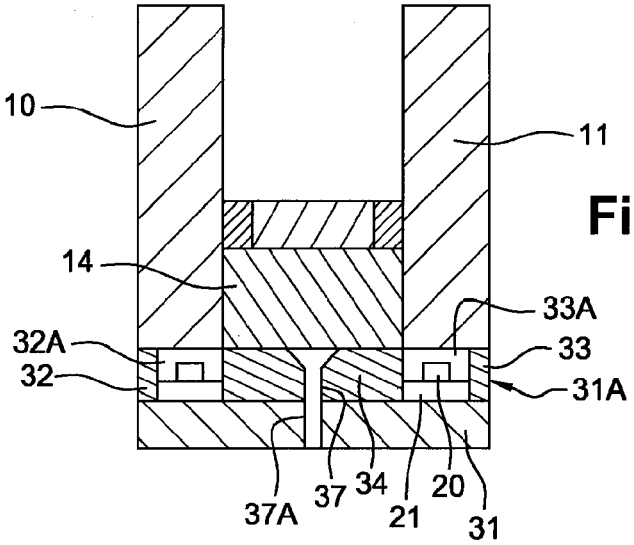
FIG. 6 is a partial lateral view of the glass panel in section taken along the line B-B in FIG. 4.

The cap 31A is fixed to the base 31, preferably by means of screws 37A passing through bores 37 through the thickness of the central portion 34 and the base 31. FIG. 6, which is a view in section taken along the line B-B in FIG. 4, shows the fixing of the cap 31A to the base 31.

The section 3 therefore forms with its base 31 and its cap 31A a protective casing for the PCBs 21 and the diodes 20, the light from which is extracted thanks to the orifices 36 (FIGS. 4 and 5).

The base 31 and its perforated cap 31A are parallel to the edge surface 1A of the glass panel in order to illuminate it, the edge surface 1A being plane and preferably not beveled.

The closed face 35 of the cap including the orifices 36 may be in direct contact with the edge surface 1A of the glass and support the glass panel, as shown in FIG. 2, with no risk of damaging the diodes.

Figure 7:
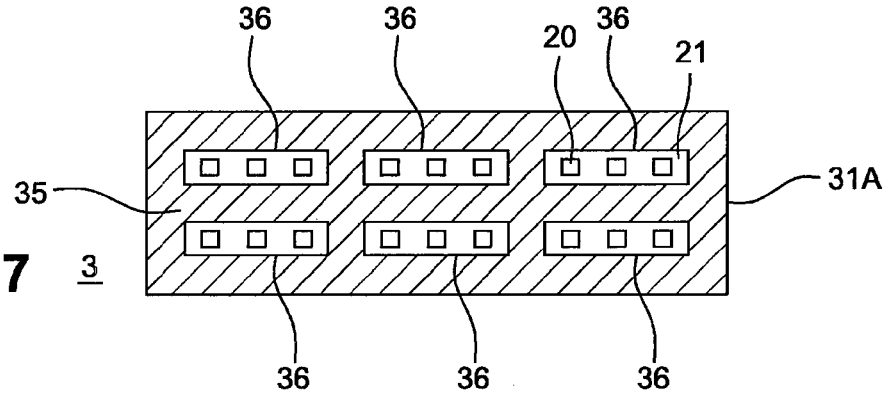
FIG. 7 is a simplified plan view of a variant of the section.

The orifices 36 of the cap may be limited to the size of each diode 20, for example with a circular shape. They may equally be of oblong shape facing a group of diodes 20, as shown in FIG. 7.

In accordance with the invention, the section 3, respectively 3A advantageously incorporates integral heat-dissipating means, in particular based on a metal, notably stainless steel, aluminum.

The heat-dissipating means are at least fastened to the PCBs 21 supporting the diodes. This makes it possible to dissipate the heat emitted by the diodes at the level of their connection to the PCBs.

The base 31 carrying the PCB support(s) (whether they are made of metal or not) preferably forms these heat-dissipating means.

In accordance with the invention, the section is designed to prevent any thermal bridge with the glass panel, in particular no metal part of the section is in contact with both sheets of glass at once. A number of variants of the bottom section and the top section are therefore envisaged, and shown here non-exhaustively.

In the preferred embodiment of the bottom section 3, the latter is made up of a plurality of elements as described above, namely the base 31, the lateral walls 32 and 33 and the central wall 34. The base 31 is made of metal whereas the lateral walls 32 and 33 which are connected to each other are made from a plastic material or at least from a material that is not thermally conductive.

Figure 8:
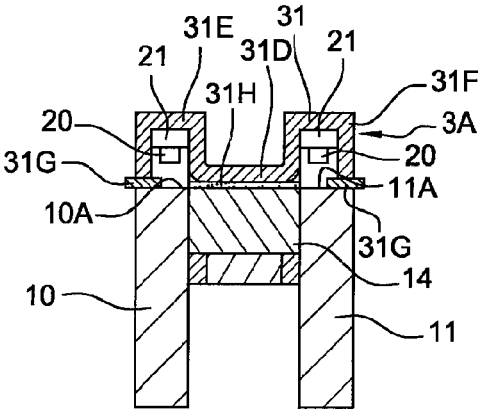
FIGS. 8 to 10 are lateral views in section of the insulated glass panel with respective variants of the section for the upper portion of the window.
Figure 9:
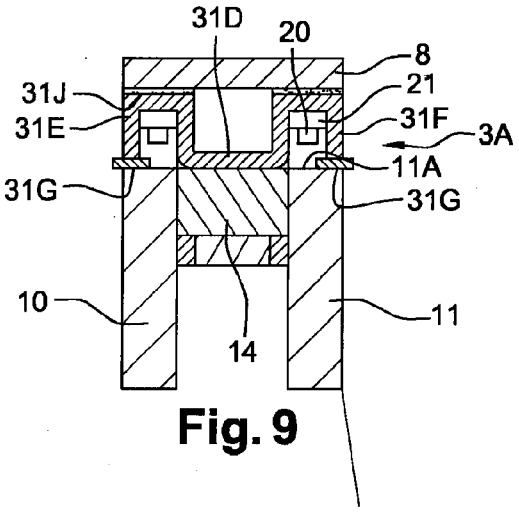
Figure 10:
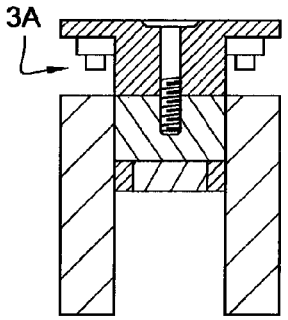

In variants shown in FIGS. 8 to 10 suitable exclusively for a top section 3A, the section consists of only the base 31, which is made of metal and is fixed directly to the mastic 14.

In FIG. 8, the base 31 extends over the whole length of the edge surface of the glass panel and includes a core 31D stuck to the mastic by fixing means 31H and two lateral wings 31E and 31F projecting from the inverted U-section core. Thermally insulative spacer means 31G are arranged between the lateral end walls of the wings 31E and 31F and the respective edge surfaces 10A and 11A of the sheets of glass, preventing any thermal bridges.

FIG. 9 shows the same type of section as FIG. 8. The section may be fixed to the mastic 14 of the glass panel or not. On the other hand, the figure shows that the section is stuck to a spacer 8 at 31J.

FIG. 10 shows a further variant of the section. The section includes a central portion in contact with the mastic and does not include any return in contact with the sheets of glass. The central portion is fixed against the mastic 14 by screws, the screw head at the end opposite the mastic not projecting from the section so the latter can therefore retain a plane surface to be placed against a spacer (the spacer is not shown here).

FIGS. 11*a* to 13*c* show a number of variants of the section 3 in which the means for dissipating heat from the diodes do not consist of the base 31 as described above but of attached means.

Figure 11A:
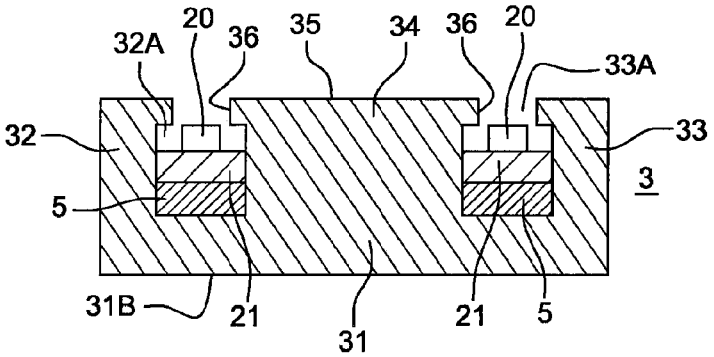
Figure 11B:
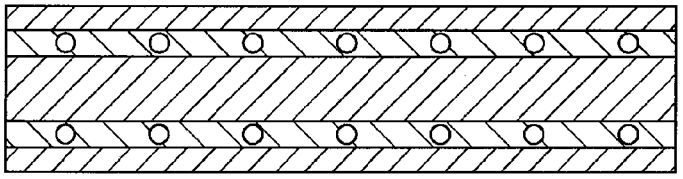

The variant of FIGS. 11*a* and 11*b* proposes a metal plate 5 accommodated in the bottom of the cavities 32A and 33A on which the PCBs 21 rest, the base 31, the central portion 34 and the lateral walls 32 and 33 forming a one-piece plastic material assembly.

Figure 12A:
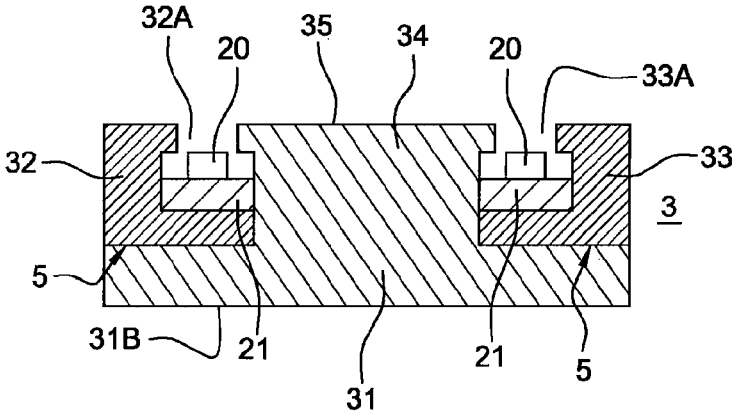
Figure 12B:
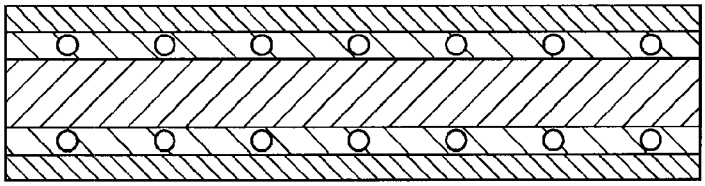

The variant of FIGS. 12*a* and 12*b* proposes a metal element 5 that forms a plate at the bottom of the cavities 32A, respectively 33A, on which the PCBs 21 rest, and the lateral wall 32, respectively 33 of the section, the rest of the section (base 31 and central wall 34) being made of plastic material.

In the above two variants, the orifices 36 in the top face of the section have a width limited to the width of the edge surface of the diodes.

Figure 13A:
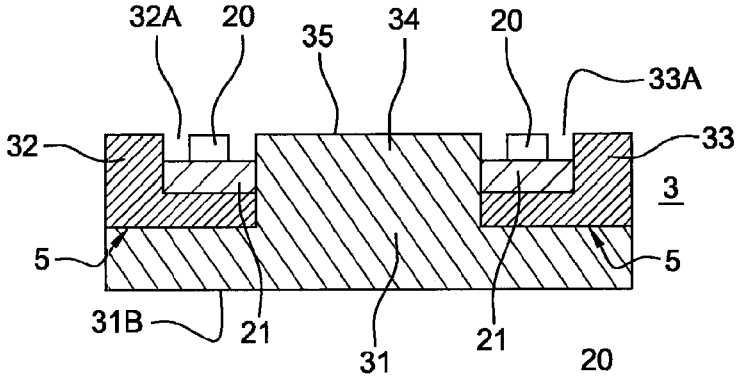
Figure 13B:
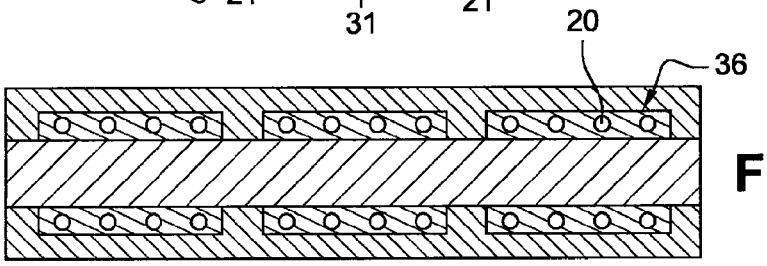
Figure 13C:
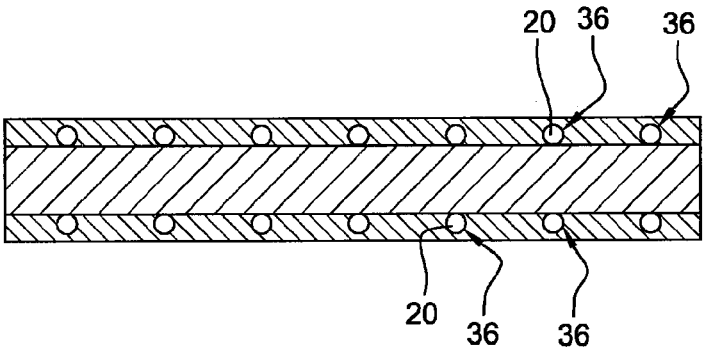

The variant of FIGS. 13*a* and 13*b* correspond to the variant of FIGS. 12*a* and 12*b*, differing in the width of the orifices 36, which corresponds to the width of the PCBs 21. Moreover the orifices are of rectangular shape for a set of diodes. Alternatively, as seen in the view from above in FIG. 13*c*, the orifices 36 are of circular shape.

By way of example, the following dimensions apply:

width of PCB: 10 mm or 5 mm, width of base 31: 12 to 15 mm for a PCB 10 mm wide, size of diodes: 3.5 mm by 3.5 mm, height of section between face 31B and face 35: 8 mm The multipart glass panel of the invention therefore provides illumination from an associated lighting system external to the glass panel and such that it can easily be replaced, being contained within at least one section assembled to the edge surface of the glass panel in a demountable manner.

Moreover, the section is preferably designed so as not to project beyond the edge surface of the glass panel and without facing the external faces of the glass panel, guaranteeing a free space for the sealed fixing of the whole of the glass panel into woodwork in the usual way.

The invention claimed is:

1. A lighting unit comprising:

an insulated and illuminated multipart glass panel, the glass panel comprising at least first and second sheets of glass spaced from each other with respective first and second edge surfaces, and associated by a peripheral seal between the first and second sheets of glass, a lighting system comprising at least one support and electrical connection device carrying light-emitting diodes disposed facing the first edge surface, and at least one section comprising a longitudinal base that carries the support and electrical connection device, wherein the section is associated with the glass panel so that the section is placed against the glass panel and an empty gap is established between a light-emitting face of the diodes and the first edge surface without creating thermal bridges between the glass panel and the section.

2. The unit as claimed in claim 1, comprising a part adapted to maintain a gap between a light-emitting face of the diodes and the glass panel.

3. The unit as claimed in claim 1, comprising a solid surface of a part or the section that is adapted to form a bearing abutment for the glass panel.

4. The unit as claimed in claim 3, wherein the solid surface forms a supporting abutment for the glass panel.

5. The unit as claimed in claim 3, wherein the solid surface forming the bearing abutment has a width equivalent to a thickness of the bottom side of the glass panel in its mounted position and is disposed against the whole of a width of an edge surface of the glass panel.

6. The unit as claimed in claim 1, wherein the section forms a support for the lighting system and for an association of said lighting system with the glass panel, association of the section with the glass panel consisting in assembly with the glass panel or placement against the glass panel.

7. The unit as claimed in claim 6, wherein the assembly is a removable assembly.

8. The unit as claimed in claim 1, wherein the section is fixed by a fastener.

9. The unit as claimed in claim 8, wherein the section is fixed only at the edge surface of the glass panel.

10. The unit as claimed in claim 8, wherein the section is fixed only to the seal.

11. The unit as claimed in claim 8, wherein the fastener is selected from the group consisting of a double-sided adhesive tape and a mechanical device of screw or clip type.

12. The unit as claimed in claim 1, wherein the section is placed against or attached to an edge surface of the glass panel without being fastened.

13. The unit as claimed in claim 1, wherein the section includes a central portion including a guide for positioning the section relative to the glass panel.

14. The unit as claimed in claim 1, wherein the section includes a top portion made of a thermally insulative material, the top portion facing and being placed against the glass panel, at least in an area that does not face the diodes, said top portion being an integral portion of the section or an attached part.

15. The unit as claimed in claim 1, wherein the section includes a top portion or the unit includes a part, the top portion of the section or said part projecting from the diodes and constituting a spacer between the diodes and the glass panel and/or a bearing surface for at least a bottom side of the glass panel when the glass panel is in use.

16. The unit as claimed in claim 1, wherein the section includes one or more housings to accommodate the diodes and their support and electrical connection device without the diodes projecting beyond a top plane of the section associated with the glass panel.

17. The unit as claimed in claim 1, wherein the section includes a bottom or base opposite the glass panel and a heat-dissipating device associated with the support and electrical connection device, the heat-dissipating device being made of metal and housed against or constituting part of the bottom.

18. The unit as claimed in claim 1, wherein the section includes two metal lateral portions forming a heat-dissipating device to dissipate the heat associated with the support and electrical connection device, the two metal lateral portions being separated from the sheets of glass by a thermally insulative material of seal or glue type or spaced from the sheets by air.

19. The unit as claimed in claim 1, wherein the section includes a base and a cap, fastened on or removable, capping the diodes and the support and electrical connection device and adapted to allow the light from the diodes to pass through towards the glass panel.

20. The unit as claimed in claim 1, wherein the section does not face the main surfaces of the glass panel, the section having a width at most equivalent to the thickness of the glass panel and facing the edge surfaces of the two sheets of glass.

21. The unit as claimed in claim 1, wherein the support and electrical connection device and the diodes are coated with an electrically insulative paint and are waterproof.

22. The unit as claimed in claim 1, wherein said unit is integrated into a frame, the section not projecting beyond external faces of the glass panel so as not to impede the returns of the frame associated with the external faces of the glass panel.

23. A method comprising using a lighting unit as claimed in claim 1, in a building, a transport vehicle, road or street lighting, or as part of a piece of furniture, or as a door, shelving unit or lid of a refrigeration equipment.

24. The unit as claimed in claim 1, wherein said unit is arranged in a door, a lid or a shelf of a refrigeration equipment.

25. The unit as claimed in claim 1, wherein the section is placed facing an edge surface of the glass panel and attached to said edge surface of the glass panel.

* * * * *